US009530545B2

(12) United States Patent
Xu

(10) Patent No.: US 9,530,545 B2
(45) Date of Patent: Dec. 27, 2016

(54) DEVICE COMPRISING A THERMAL FUSE AND A RESISTOR

(71) Applicant: Zhonghou Xu, Xiamen (CN)

(72) Inventor: Zhonghou Xu, Xiamen (CN)

( * ) Notice: Subject to any disclaimer, the term of this patent is extended or adjusted under 35 U.S.C. 154(b) by 0 days.

(21) Appl. No.: 14/957,614

(22) Filed: Dec. 3, 2015

(65) Prior Publication Data

US 2016/0086757 A1 Mar. 24, 2016

Related U.S. Application Data

(63) Continuation-in-part of application No. 13/977,672, filed on Jun. 28, 2013, now Pat. No. 9,240,300.

(51) Int. Cl.

| | |
|---|---|
| ***H01C 3/20*** | (2006.01) |
| ***H01H 85/055*** | (2006.01) |
| ***H01H 85/165*** | (2006.01) |

(52) U.S. Cl.

CPC ..... *H01C 3/20* (2013.01); *H01H 85/055* (2013.01); *H01H 85/165* (2013.01)

(58) Field of Classification Search

CPC ..... H01C 3/20

See application file for complete search history.

(56) References Cited

U.S. PATENT DOCUMENTS

| | | | | |
|---|---|---|---|---|
| 3,238,489 | A * | 3/1966 | Hay | H01C 3/20 174/16.3 |
| 4,006,443 | A * | 2/1977 | Kouchich | H01C 7/001 219/517 |
| 5,418,516 | A * | 5/1995 | Oh | H01H 85/048 338/21 |
| 8,314,677 | B1 * | 11/2012 | Kuo | H01C 1/14 338/264 |
| 2015/0294826 | A1 * | 10/2015 | Kim | H01H 37/32 337/382 |
| 2016/0042905 | A1 * | 2/2016 | Xu | H01H 85/36 337/148 |
| 2016/0086757 | A1 * | 3/2016 | Xu | H01H 85/055 337/183 |

* cited by examiner

*Primary Examiner* — James Harvey

(74) *Attorney, Agent, or Firm* — Gokalp Bayramoglu

(57) ABSTRACT

The present invention discloses a device comprising a thermal fuse, a resistor and a protective casing. The protective casing provides housing for the thermal fuse and the resistor and increases the anti-explosion properties and insulating and voltage-withstanding properties at the same time. The thermal fuse and the resistor can be used as a basic unit and be directly installed into a switch-mode power supply. It is capable of replacing the existing simple wire-wound resistor or the wirewound resistor with an external contact type thermal fuse, and realizing the functions of general impedance, over-current fuse protection, surge protection, anti-explosion and over-temperature protection in case of overloading.

20 Claims, 7 Drawing Sheets

DEVICE COMPRISING A THERMAL FUSE AND A RESISTOR

CROSS-REFERENCES TO THE RELATED APPLICATIONS

This application is a continuation-in-part of prior patent application with the application Ser. No. 13/977,672, filed on Jun. 28, 2013, titled "device combining a thermal fuse and a resistor".

FIELD OF THE INVENTION

The present invention relates to a resistor and a thermal fuse integration against over-current and over-temperature and more specifically relates to an integration of a resistor and a thermal fuse within a protective casing. The size of the device is similar to an existing wirewound resistor, carbon-film resistor or a metal-film resistor under the same power. The device is used as over-heating protection resistor in a power supply such as the household electric appliance, IT communication equipment or lighting equipment. It can also be used as a heating element with over-heating protection.

The present invention further relates to a thermal fuse with self-heating function. It can be applied in blockage protection of the motor of the power tool or electrical fan. When the motor is blocked, the current causes the thermal fuse cut off by self-heating faster than the increasing rate of the temperature of the coil of the motor, thus assuring that the motor will not damage under over-heating condition before the cut-off of the thermal fuse. The device can be effectively used against over-heating of the motor.

BACKGROUND OF THE INVENTION

With wide application of micro-electrical equipment, especially the mobile communication equipment, charging device for battery becomes the necessity of the mobile equipment. A high-frequency circuit is usually used to design and build a charger for convenient carriage and self-adaptation to the AC100V~240V mains voltage; therefore, the safety performance of the charger becomes particularly important. A current-limiting resistor against over-current and over-temperature is the key component for the safety of the high-frequency circuit. The present invention provides to meet the demand of safety requirements, further achieving reliability and quick response.

Although the wirewound resistor also has an over-current fuse function, the resistor wire is applied with a high melting point alloy and the alloy wire of the wirewound resistor will melt to realize fuse function, only if subjected to a power which is over 20 times of the rated power. However, in actual applications, when the load is abnormal, the current of the wirewound resistor is often unable to reach the current level, where the resistance wire of the resistor can cut off, and causes the fuse function of the wirewound resistor to not be realized, while the temperature of the wirewound resistor reaches 300° C.~500° C. or even much higher. This is a serious problem and a dangerous condition for the charger since shell of the charger melts and more seriously a fire occurs when being placed under such high temperature. Under these conditions, people use an external contact type thermal fuse connected in series and placed inside a ceramic box, and when the thermal fuse senses that the temperature of the wirewound resistor reaches the rated temperature of the thermal fuse, the thermal fuse will melt to cut off the circuit. However, thermal fuse occupies additional area in the PCB and it needs 4 bonding pads under such operation.

Moreover, for the safety considerations, the micro-heating elements used in daily life, such as aromatherapy diffuser or mosquito repellant electric liquid vaporizer, are applied with a thermal fuse against over-heating. Existing assembly method is to connect a resistor and a thermal fuse in series, then assemble the unit inside a ceramic box, and the box is filled with solidifiable insulating material. This increases the size of the product; therefore, the heat may be lost and the energy may be wasted.

In addition, the current of the motor of a power tool or an electrical fan is six times the normal working current when they are blocked, under which condition the motor heats quickly. It needs a thermal fuse to cut off the current to prevent a fire because of over-heating condition, but it is not expected to decrease the operation temperature of the thermal fuse to increase the agility. However, mild overload or voltage pulsation happens when the motor works. Under these mild conditions, the thermal fuse is expected not to be cut off so there is an issue with setting up the temperature of the thermal fuse.

Moreover, existing insulation coating uses brittle material to encapsulate the whole device. The device is commonly used in the switch-mode power supply (hereinafter referred to as SMPS), and when explosion occurs due to a shortcircuit of the electric components connected thereafter, the brittle material splashes all over the circuit board.

The structure of a component comprising a thermal fuse, a resistor and protective casing of new, small size, where an integrated structure and fast installation is provided, which solves above problems.

SUMMARY OF THE INVENTION

The present invention discloses a resistor and a thermal fuse integration used in the input circuit of a switch mode power supply. In one specific embodiment, the resistor is a metal wire resistor, which not only has a resistor function, but also has an over-current fuse protecting function. In the circuit, a thermal fuse is disposed inside the base of the resistor and connected to the resistor in series. When the resistor heats to the rated temperature, the thermal fuse melts and provides an over-heating protection function.

The present invention relates to a resistor with a built-in thermal fuse, in which the solid ceramic base of the resistor is changed to be hollow. A lead wire of the thermal fuse passes through an end cap of an end of the resistor, connecting tightly thereto and forming a serial connection structure. The other lead wire of the thermal fuse extends out of the end cap of the other end of the resistor, the end cap of the resistor with an opening extends outwardly with a lead wire, and then the device is encapsulated in an insulation coating.

The present invention discloses a resistor and a thermal fuse integration with protective casing. The protective casing has both the function of keeping the brittle coating inside its chamber and increasing the insulating and voltage-withstanding properties. In one specific embodiment, the protective casing can be a shell or a casing tube, which provides housing for the whole device. When explosion occurs, brittle material is prevented from splashing all over the circuit board and, therefore is kept inside the inner chamber of the protective casing.

The present invention of a resistor with a built-in thermal fuse can be used as a basic unit to be assembled directly to the existing SMPS. The resistor with a built-in thermal fuse can take the place of the existing simple wirewound resistor, or the wirewound resistor with an external contact type thermal fuse, realizing the functions of general impedance, over-current fuse protection, and over-temperature protection in the event of overloading.

The resistance value of the resistor with above structure is set at 0.5Ω, and the temperature of the coupling thermal fuse is 150° C., when it is used in a motor of a power tool. Take a thermal fuse with rated current 2 A for example, when the normal working current is 0.5 A, the temperature of the thermal fuse rises about 5° C. due to the resistor. However, when the motor is blocked, the current reaches 3 A, the heat of the resistor makes the temperature of the thermal fuse rise rapidly, and therefore the thermal fuse is cut off before the motor coil is damaged.

In one specific embodiment, the resistor is a carbon-film resistor, a metal oxide film resistor or a metal-film resistor. The resistor value is increased greatly. This structure can be used in micro-heaters, by being fixed into a ceramic tube to serve as a heater of an aromatherapy diffuser or mosquito repellant electric liquid vaporizer, and the heater can be placed in a diffusing stick of perfume or other liquid, so that the thermal power of the heater can be absorbed by the perfume or other liquid. Existing technology is applied with a ceramic structure; a side of which is disposed with a hole to fix the diffusing stick, while the other side is disposed with a cavity for assembling a heating resistor and a thermal fuse and is sealed with solidifiable insulation material. Comparing the above two manners, which are based on the same diffusion rate of the perfume, as per the existing technology, the power of the heater is about 2.2 W, whereas the power of the heater of the present invention is about 1 W. As a result, heating temperature of the resistor is decreased accordingly, the stability of the resistor value of the resistor is improved greatly, the diffusion rate of the perfume is more stable, and the influence under the environmental temperature is decreased. If the power of each aromatherapy diffuser decreases 1 W, total power of 9 kW can be saved every year. If there are 50 million functioning heaters in the world, such as aromatherapy diffuser or mosquito repellant electric liquid vaporizer, a total power of 45000 kW can be saved; therefore, carbon emission can be decreased greatly.

DETAILED DESCRIPTION OF THE EMBODIMENTS

The First Embodiment

Figure 1:
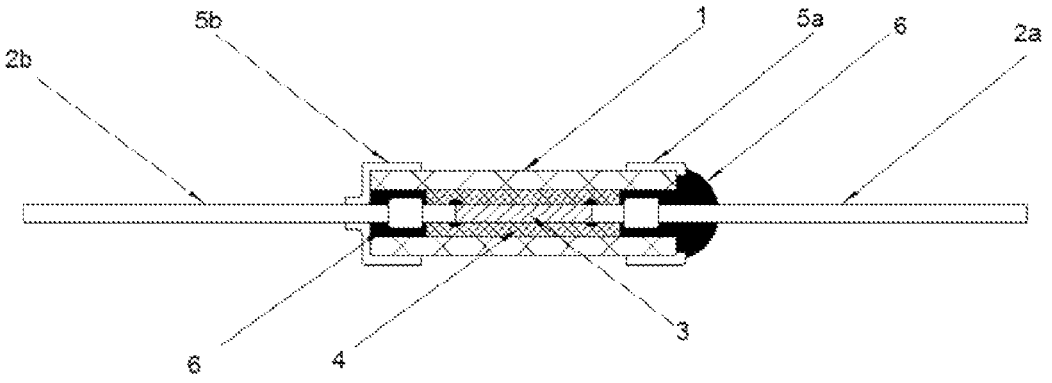
FIG. 1 illustrates the circuit diagram of the first embodiment.
Figure 2:
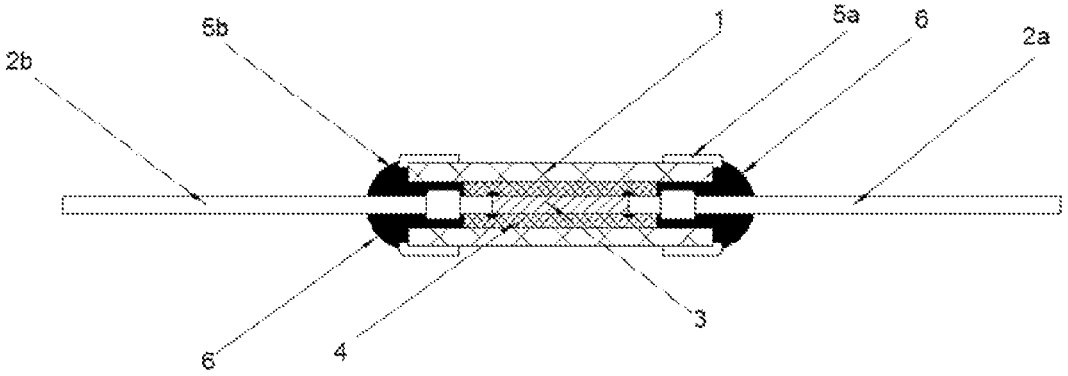
FIG. 2 illustrates a sectional view of the first embodiment with a built-in thermal fuse.

The first embodiment will be further described with the FIG. 1 and FIG. 2. Therein, the object of the embodiment is to describe the preferred embodiment of the present invention, but not limited by the specific embodiment.

In FIGS. 1-2, lead wires 2*b*, 2*a* of thermal fuse are welded with a temperature sensing body. In one specific embodiment, the temperature sensing body is a fusible metal wire 3 with a low-melting point. Fluxing promoting agent 4 is disposed around metal wire 3 to improve the metal wire to contract oppositely to cut off when melting. Thermal fuse, fluxing promoting agent 4 and metal wire 3 form an integration under normal temperature and are placed inside ceramic tube 1, then two ends of ceramic tube 1 are sealed with an insulating material as an entire thermal fuse. In this embodiment, the insulating material is epoxy resin 6. In other specific embodiment, the resistor and the thermal fuse share the same ceramic tube 1.

As illustrated in FIG. 1, when above thermal fuse is formed, a first metal cap 5*a* and a second metal cap 5*b* are used to lock the two ends of ceramic tube 1 of thermal fuse, forming a tight integration. The center of first metal cap 5*b* extends outwardly to form a lip-like edge, which is electrically connected to second lead wire 2*b* of thermal fuse. After first metal cap 5*b* is welded to a resistor body of the wirewound resistor, the thermal fuse and the wirewound resistor are connected in series. First metal cap 5*a* has a center hole large enough for the first lead wire 2*a* of thermal fuse to pass through. A clearance is formed between the center hole and first lead wire 2*a*. The creepage distance between first lead wire 2*a* and first metal cap 5*a* is increased to a safe distance after the clearance is solidified with epoxy resin 6. FIG. 2 shows that clearances are correspondingly formed between the center hole and first lead wire 2*a* and second lead wire 2*b*. The creepage distance between first lead wire 2*a* and first metal cap 5*a*, and the creepage distance between second lead wire 2*a* and second metal cap 5*a* are increased to a safe distance after the clearance is solidified with epoxy resin 6.

Figure 3A:
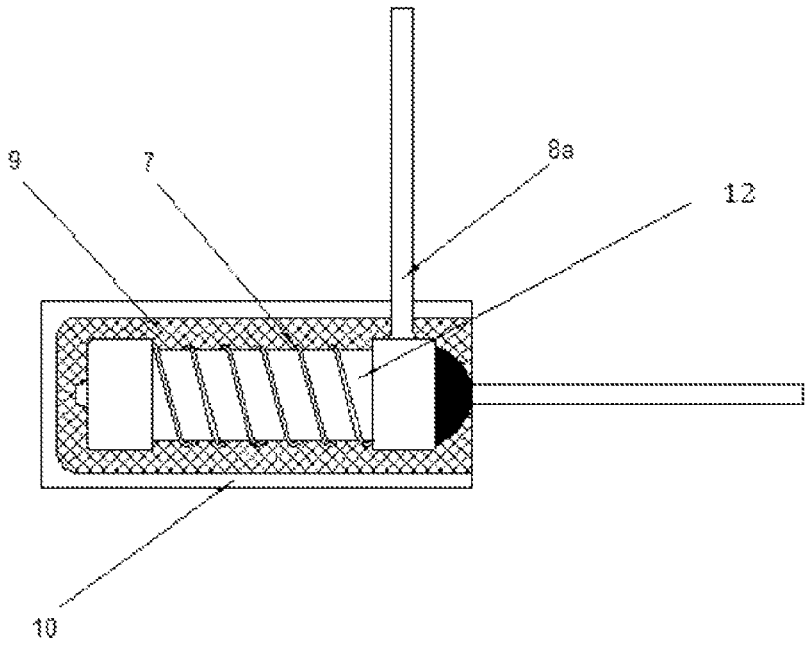
FIGS. 3*a-c* illustrates a serial structure between a resistor and a thermal fuse with a protective casing.
Figure 3B:
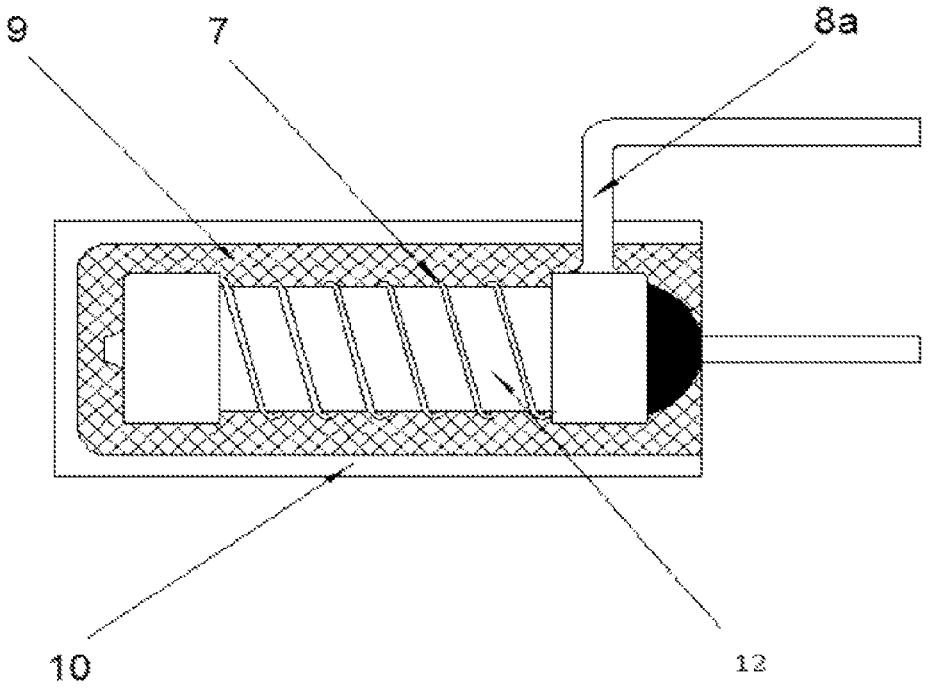
Figure 3C:
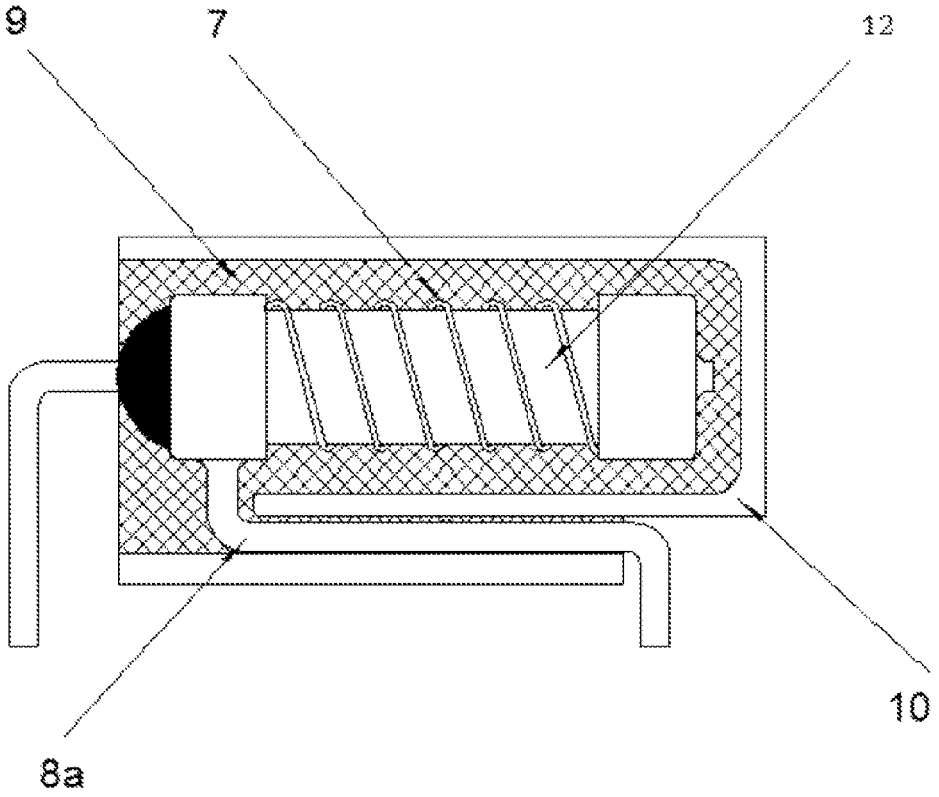
Figure 3D:
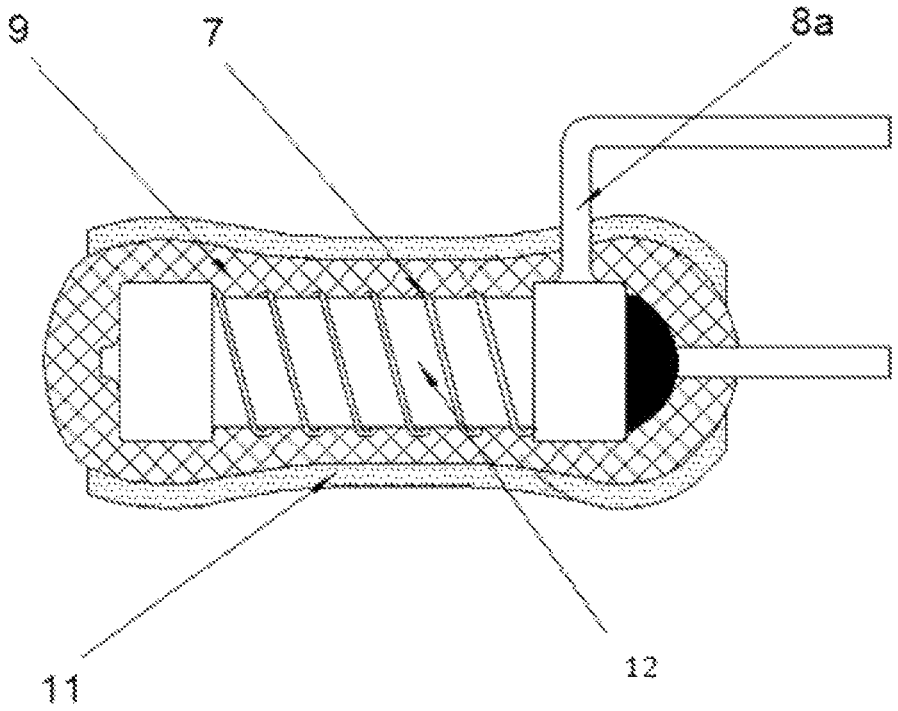
FIG. 3*d* illustrates a serial structure between a resistor and a thermal fuse with a casing pipe.

In FIGS. 3*a-d*, after two ends of ceramic tube 1 of thermal fuse 12 are sleeved with first metal caps 5*a* and second metal tube 5*b*, a basic body of the wirewound resistor is shaped. A resistor is located on the basic body. In this embodiment, the resistor body is an impedance alloy wire 7. Two ends of impedance alloy wire 7 are respectively welded to first metal cap 5*a* and second metal cap 5*b*. Then third lead wire 8*a* is further welded to first metal cap 5*a* as the output of the wirewound resistor. The device is encapsulated with insulating material. The insulating material can be selected from a group consisting of epoxy resin, silicone resin, silicone rubber or the like. FIGS. 3*a-c* show a resistor and a thermal fuse integration with protective casing 10. Protective casing 10 has both functions of keeping the brittle coating inside its inner chamber, and increasing the insulating and voltage-withstanding properties. Protective casing 10 can be a casing pipe 11, which is retractable or non-retractable, see FIG. 3*d*. In this embodiment, the protective casing is a retractable casing pipe. Protective casing 10 is located on the outer surface of insulation coating and provides housing for the inner structure. Protective casing 10 can be made from ceramic or plastic material. Since the materials used for insulation coating are brittle materials, when explosion occurs, the disintegrating slags generated by the explosion are kept inside the inner chamber of protective casing 10. The setting of protective casing 10 can suppress the occurrence of explosion and no booming sound is generated. Even if the explosion occurs, the explosion can be kept inside the chamber of the casing, thus preventing the insulating coating from splashing. Furthermore, the insulating and voltage-withstanding properties can be increased by the additional setting of protective casing 10. In this way, a wirewound resistor with a built-in thermal fuse is achieved. A voltage withstanding comparison experiment between the existing coating-type resistor and a resistor and a thermal fuse integration with a casing is depicted in table 1. Table 1 shows that a resistor and a thermal fuse integration with a casing can withstand much higher voltage than the existing coating-type resistor does.

TABLE 1

| Test Voltage (V a.c.) | Existing coating-type resistor | a thermal fuse integration with a casing |
|---|---|---|
| 2000 | PASS | PASS |
| 2500 | PASS | PASS |
| 3000 | PASS | PASS |
| 3500 | FAIL | PASS |
| 4000 | FAIL | PASS |
| 4500 | FAIL | PASS |
| 5000 | FAIL | PASS |

Figure 3E:
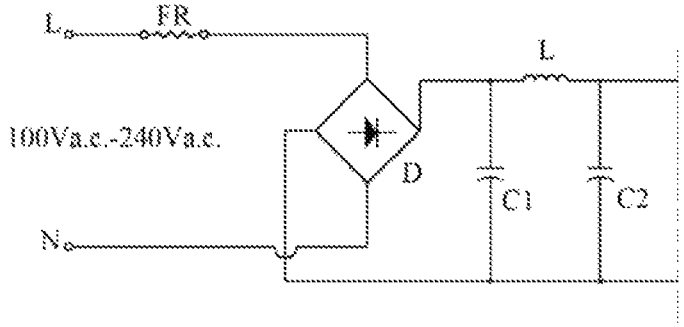
FIG. 3*e* schematically shows a circuit diagram when a resistor is applied in a switch power type charger as an over-current protecting component.

FIG. 3*e* schematically shows a circuit diagram when a resistor (hereinafter referred to as FR) is applied in a switch power type charger as an over-current protecting component. During the charging process, chances are that a short current phenomenon occurs in the rectifier bridge, filter capacitor or the metal oxide semiconductor (MOS). The FR component endures the whole voltage (i.e. 100~240V) as is previously divided among the components in series connection. When existing coating-type resistor (like wire-wound resistor) is being applied as an FR, the resistance wire of existing coating-type resistor cuts off when enduring a whole voltage. Accompanying are the big arc and huge booming sounds which terrify people nearby. However, when a resistor and a thermal fuse integration with a casing in this embodiment is being used as an FR, problems referred above will be omitted since the big arc and the huge booming sounds are suppressed inside the casing. The following table (table 2) shows the comparison results between the manufactured existing coating-type resistor and a resistor and a thermal fuse integration with a casing when being placed under short circuit voltage.

TABLE 2

Comparative Test Report of Explosion

| Short Circuit Voltage (V a.c.) | existing coating-type resistor | a resistor and a thermal fuse integration with a casing |
|---|---|---|
| 220 | Large spark & big explosion sound | Without spark or big explosion sound |
| 240 | Large spark & big explosion sound | Without spark or big explosion sound |

Figure 4A:
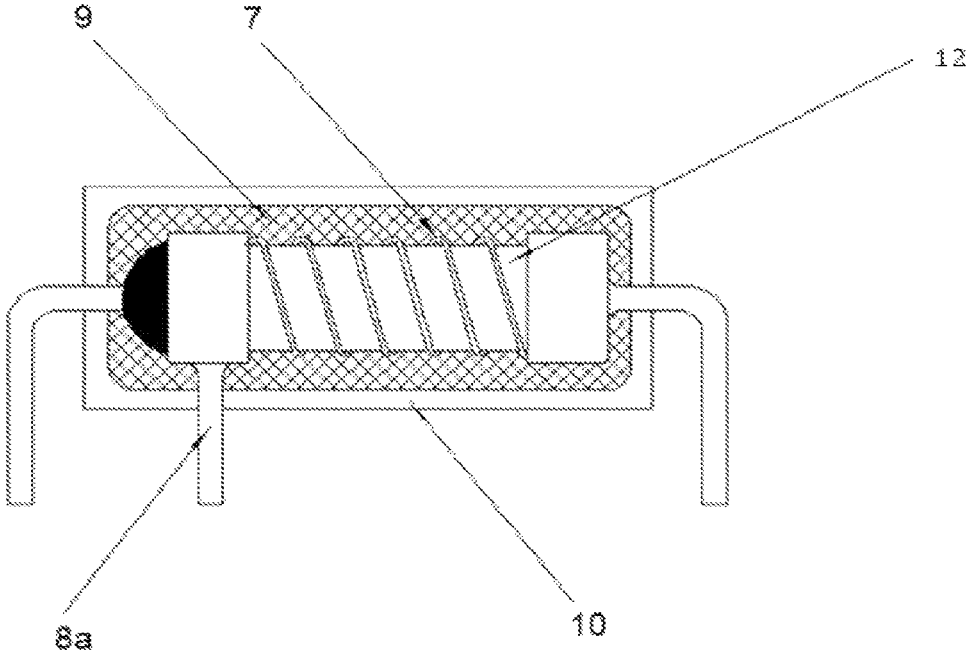
FIG. 4*a* illustrates an integration structure for triple use with a protective casing.
Figure 4B:
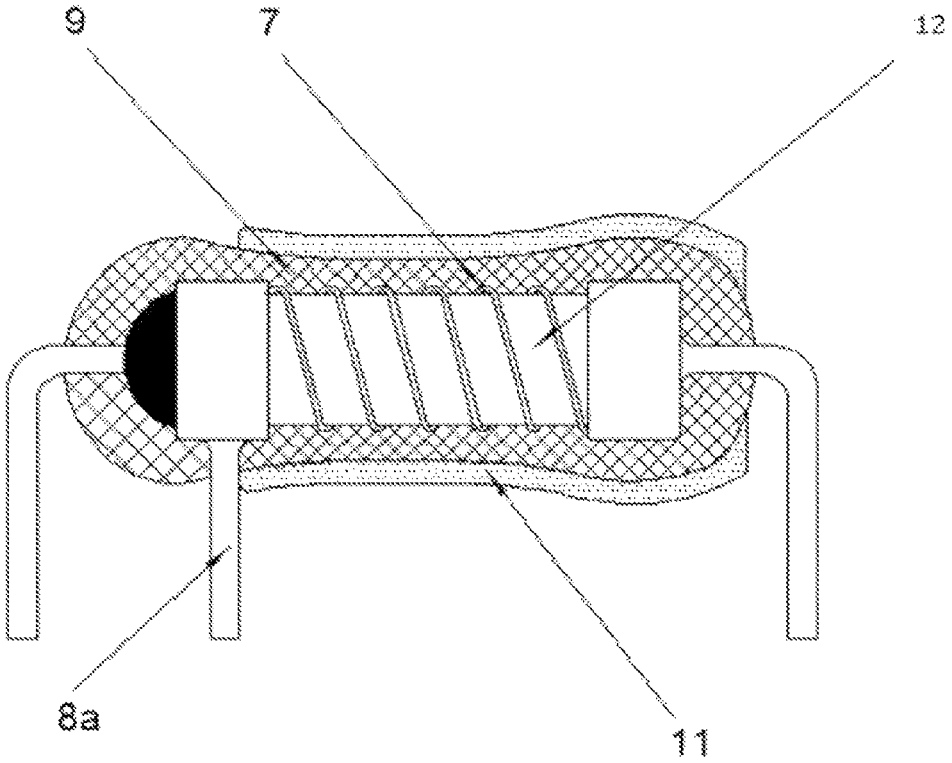
FIG. 4*b* illustrates an integration structure for triple use with a casing pipe.

FIG. 4*a* schematically shows a resistor and thermal fuse 12 integration with protective casing 10. The resistor comprises resistor body 7 and third lead wire 8*a*. Third lead wire 8*a* is welded to first metal cap 5*a* and forms a structure for triple use. FIG. 4*b* schematically shows the resistor and thermal fuse 12 integrating with casing pipe 11. In one specific embodiment, the casing pipe is a heat-shrinkable tube or a non-heat-shrinkable tube.

The Second Embodiment

Figure 5A:
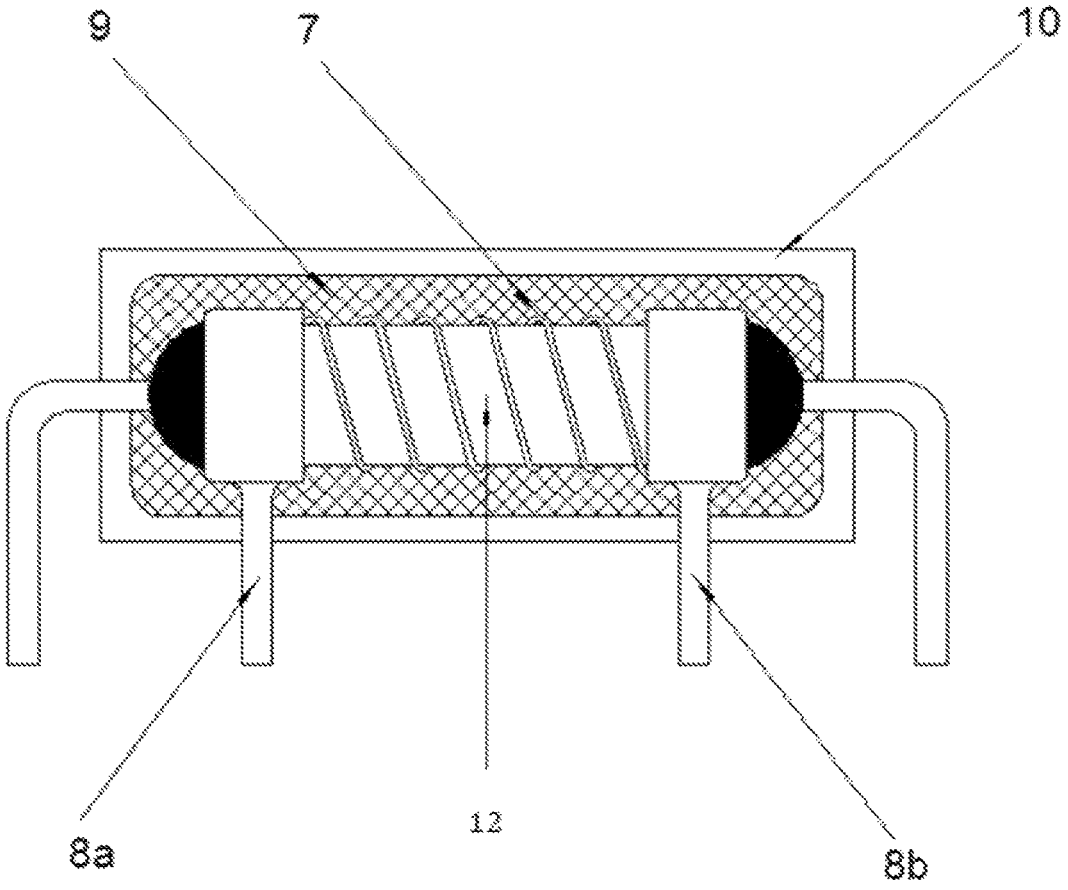
FIG. 5*a* illustrates a parallel structure between a resistor and a thermal fuse with protective casing.
Figure 5B:
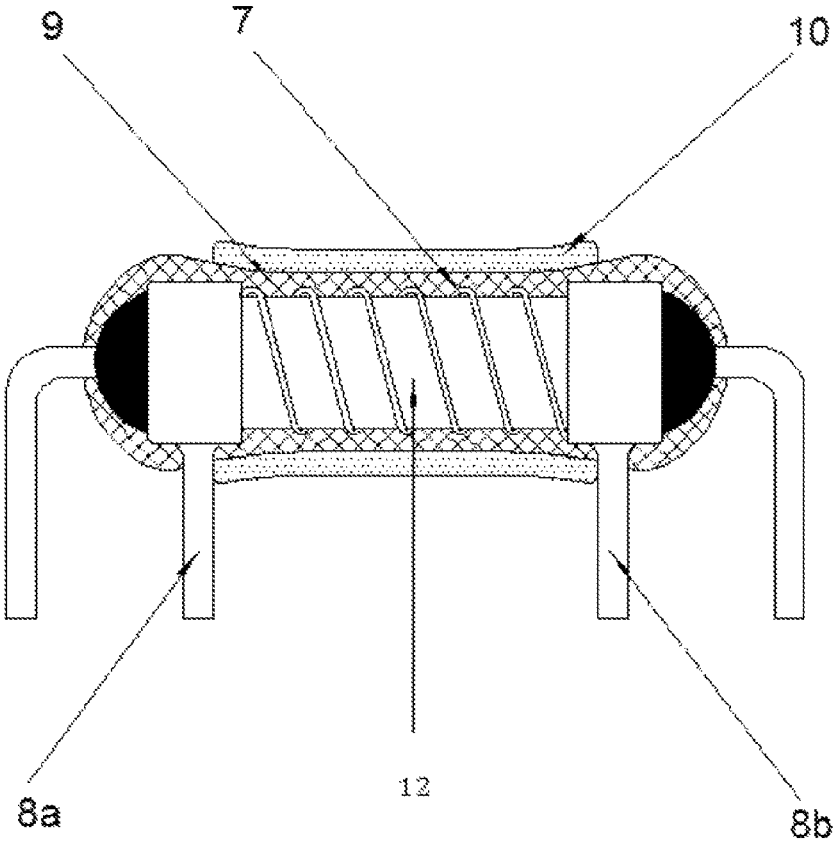
FIG. 5*b* illustrates a parallel structure between a resistor and a thermal fuse with a casing pipe.

As illustrated in FIG. 5*a* and FIG. 5*b*, different from the first embodiment, the thermal fuse and the wirewound resistor are disposed in a parallel circuit; the wirewound resistor is wound on the ceramic tube of the thermal fuse. Third lead wire 8*a* and fourth lead wire 8*b* of two ends of the wirewound resistor are not connected to the lead wires of the thermal fuse (i.e. first lead wire 2*a* and second lead wire 2*b*).

The Third Embodiment

The table below shows the protection result data of the wirewound resistor with a thermal fuse in the first embodiment. In a switch-mode power supply (SMPS), it often applies a 10 Ω/2 W wirewound resistor and a 221° C. thermal fuse against over-heating. The comparison of cut-off speed between the external contact type and the built-in type (the first embodiment) is as below. If single wirewound resistor is not added, prolonged exposure to high surface temperature for a long time is poses a potential danger under the currents listed in the table.

TABLE 3

| Number | Test Current (A) | Surface Temperature of the External Contact Type Resistor (° C.) | Cut-off Time of the External Contact Type Thermal Fuse(s) | Surface Temperature of the Built-in Type Resistor (° C.) | Cut-off Time of the Built-in Type Thermal Fuse(s) |
|---|---|---|---|---|---|
| 1 | 0.5 | 142 | Not Cut-off in 600 s | 145 | Not Cut-off in 600 s |
| 2 | 0.5 | 139 | Not Cut-off in 600 s | 142 | Not Cut-off in 600 s |

TABLE 3-continued

| Number | Test Current (A) | Surface Temperature of the External Contact Type Resistor (° C.) | Cut-off Time of the External Contact Type Thermal Fuse(s) | Surface Temperature of the Built-in Type Resistor (° C.) | Cut-off Time of the Built-in Type Thermal Fuse(s) |
|---|---|---|---|---|---|
| 3 | 0.5 | 146 | Not Cut-off in 600 s | 148 | Not Cut-off in 600 s |
| 4 | 0.5 | 143 | Not Cut-off in 600 s | 145 | Not Cut-off in 600 s |
| 5 | 0.6 | 175 | 36 s | 176 | 18 s |
| 6 | 0.6 | 174 | 37 s | 177 | 19 s |
| 7 | 0.6 | 178 | 36 s | 176 | 18 s |
| 8 | 0.6 | 176 | 39 s | 178 | 18 s |
| 9 | 0.7 | 189 | 26 s | 190 | 8 s |
| 10 | 0.7 | 187 | 27 s | 192 | 7 s |
| 11 | 0.7 | 190 | 23 s | 193 | 8 s |
| 12 | 0.7 | 188 | 24 s | 189 | 7 s |
| 13 | 0.8 | 211 | 14 s | 215 | 1.2 s |
| 14 | 0.8 | 209 | 16 s | 212 | 1.0 s |
| 15 | 1 | 234 | 8 s | 238 | 0.2 s |
| 16 | 1 | 232 | 9 s | 242 | 0.7 s |

The Fourth Embodiment

The structure of the fourth embodiment is the same as that of the first embodiment, but with a different resistance value and temperature from the first embodiment. The heating of the wirewound resistor accelerates the cut-off of the thermal fuse, which is mainly used in the motor against over-temperature. The resistance value of the wirewound resistor, with above structure is set at 0.5Ω. The temperature of the coupling thermal fuse is 150° C. when used in a motor of a power tool, take a thermal fuse with rated current 2 A for example: when the normal working current is 0.5 A, the temperature that the thermal fuse senses rises about 5° C. due to the resistor. However, when the motor is blocked, the current reaches 3 A, and the heat of the resistor makes the temperature of the thermal fuse to rise rapidly, and therefore the thermal fuse is cut off before the motor coil is damaged, preventing the motor coil from burning and improving the recycling value. It can be further described with the data below:

TABLE 4

| Number | Fusing Current (A) | Temperature of the Simulation Coil (° C.) | Surface Temperature of the Wirewound Resistor (° C.) | Cut-off Time of the TCO | Withstand Voltage |
|---|---|---|---|---|---|
| 1 | 0.5 | 62.8 | 74.9 | Not cut-off in a long time | |
| 2 | 0.5 | 63.1 | 75.4 | Not cut-off in a long time | |
| 3 | 0.5 | 62.9 | 75.8 | Not cut-off in a long Time | |
| 4 | 1 | 63.6 | 90.2 | Not cut-off in a long time | |
| 5 | 1 | 63.8 | 90.8 | Not Cut-off in a long time | |
| 6 | 1 | 63.9 | 91.4 | Not cut-off in a long time | |
| 7 | 1.5 | 64.5 | 107.4 | Not cut-off in a long time | No Breakdown under 500 V |
| 8 | 1.5 | 64.6 | 106.9 | Not cut-off in a long time | No Breakdown under 500 V |
| 9 | 1.5 | 64.7 | 107.8 | Not Cut-off in a long time | No Breakdown under 500 V |
| 10 | 2 | 65.4 | 132.5 | 58 | No Breakdown under 500 V |
| 11 | 2 | 65.5 | 132.1 | 52 | No Breakdown under 500 V |
| 12 | 2.5 | 66.7 | 162.7 | 7 | No Breakdown under 500 V |
| 13 | 2.5 | 66.4 | 160.2 | 6 | No Breakdown under 500 V |
| 14 | 3 | 69.4 | 167.5 | 3 | No Breakdown under 500 V |

The Fifth Embodiment

Figure 6:
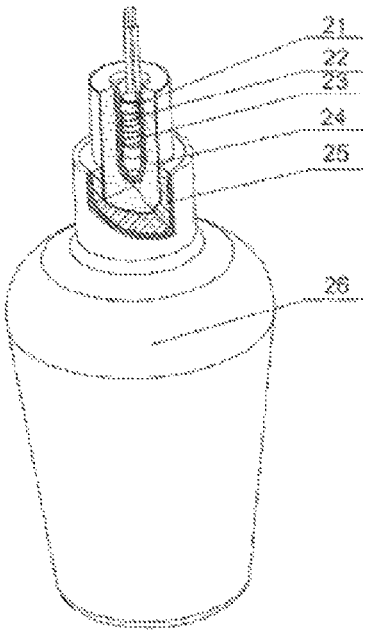
FIG. 6 illustrates the structure of fourth embodiment of a resistor comprising a built-in thermal fuse with organic matter for sensing temperature.

The structure of the fifth embodiment resembles the first embodiment. It replaces the wirewound resistor with a carbon-film resistor, a metal oxide film resistor or a metal-film resistor 22. The resistance value is increased to thousands of ohms; therefore, this structure can be used as micro-heater 21 (as illustrated in FIG. 6). Micro-heater 21 with a built-in thermal fuse is made into an aromatherapy diffuser, comprising micro-heater 21, housing 23, diffusing stick. 24, sealing ring 25, and perfume bottle 26. By putting housing 23 with built-in micro-heater 21 into diffusing stick 24, then inserting diffusing stick 24 into perfume bottle 26 through sealing ring 25, the aromatherapy diffuser is achieved.

TABLE 5

Comparative Test Report of Resistor Heating

| Assembly Type of the Heating Resistor | Test Voltage (V a.c.) | Current (mA) | Real Power (W) | Resistance Value (kΩ) | Surface Temperature (° C.) | Temperature of the Diffusing Stick (° C.) |
|---|---|---|---|---|---|---|
| a Resistor with a 130° C. External Contact Thermal Fuse is Encapsulated by Ceramic Housing | 120 | 18.52 | 2.2 | 6.5 | 97.5 | 89.6 |
| a Resistor with a 130° C. External Contact Thermal Fuse is Encapsulated with Ceramic Housing | 120 | 18.51 | 2.2 | 6.5 | 94.3 | 88.2 |
| a Resistor with a 130° C. External Contact Thermal Fuse is Encapsulated with Ceramic Housing | 120 | 18.55 | 2.2 | 6.5 | 95.6 | 87.9 |
| a Resistor with a 130° C. External Contact Thermal Fuse is Encapsulated with Ceramic Housing | 120 | 18.52 | 2.2 | 6.5 | 96.8 | 86.5 |
| a Resistor with a 130° C. External Contact Thermal Fuse is Encapsulated with Ceramic Housing | 120 | 18.53 | 2.2 | 6.5 | 95.8 | 87.9 |
| a Resistor with a Built-in Thermal Fuse | 120 | 10.4 | 1.25 | 11.5 | 92 | 92 |
| a Resistor with a Built-in Thermal Fuse | 120 | 10.4 | 1.25 | 11.5 | 90.8 | 90.8 |
| a Resistor with a Built-in Thermal Fuse | 120 | 10.4 | 1.25 | 11.5 | 93.2 | 93.2 |
| a Resistor with a Built-in Thermal Fuse | 120 | 10.4 | 1.25 | 11.5 | 92.7 | 92.7 |
| a Resistor with a Built-in Thermal Fuse | 120 | 10.4 | 1.25 | 11.5 | 91.8 | 91.8 |

According to the above data comparison, under equal temperature of the diffusing stick, the power consumption of this embodiment saves 50% of power to existing technology.

The Sixth Embodiment

Figure 7:
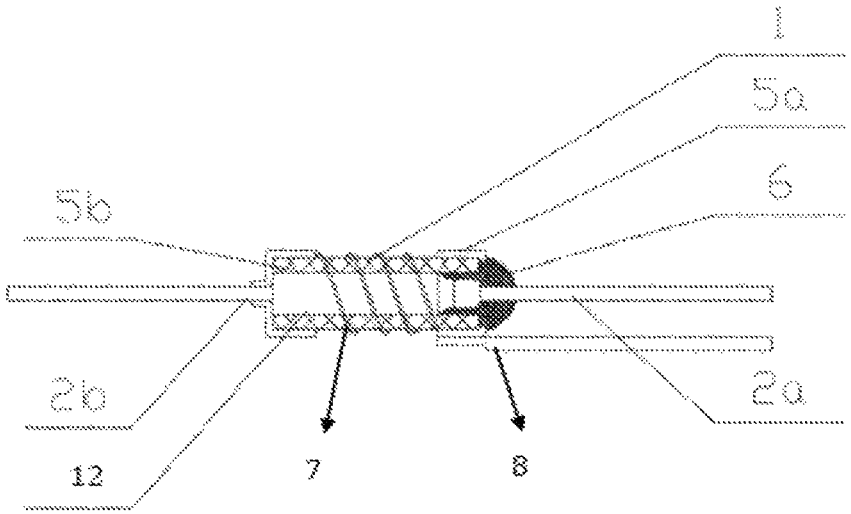
FIG. 7 illustrates thermal fuse with organic matter for sensing temperature.
Figure 8:
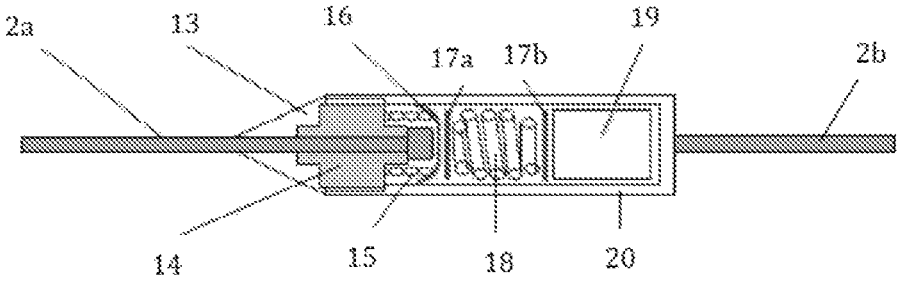
FIG. 8 illustrates the principle diagram of the seventh embodiment of a resistor comprising a built-in thermal fuse with organic matter for sensing temperature.

As illustrated in FIG. 7, thermal fuse 12 with organic matter for sensing temperature is disposed inside ceramic tube 1 (the principle structure is illustrated in FIG. 8). Two ends of ceramic tube 1 are tightly locked with first metal cap 5*a* and second metal cap 5*b*, thus forming a tight integration. The center of second metal cap 56*b* extends outwardly to form a lip-like edge, which is tightly connected to second lead wire 2*b* of thermal fuse 12. After second metal cap 5*b* is welded with the resistor body of the wirewound resistor, the thermal fuse and the wirewound resistor are connected in series. First metal cap 5*a* has a center hole large enough for the first lead wire 2*a* of thermal fuse 12 to pass through, and a clearance is formed between the hole and first lead wire 2*a*. The creepage distance between first lead wire 2*a* and first metal cap 5*a* is increased to a safe distance after the clearance is solidified with the insulating material 6. In this embodiment, the first insulating material 6 is epoxy resin. When the shape of second metal cap 5*b* is the same as first metal cap 5*a*, and second lead wire 2*b* of thermal fuse 12 is capable of passing through the center of second metal cap 5*b*, and a clearance is formed between the hole and second lead wire 2*b*; the creepage distance of second lead wire 2*b* and second metal cap 5*b* is increased to a safe distance after the clearance is solidified with epoxy resin. In this embodiment, the resistor and the thermal fuse have no electrical connection, but there is quick thermal transfer.

After two ends of ceramic tube 1 of the thermal fuse are tightly sleeved with first metal cap 5*a* and second metal cap 5*b*, a basic body of the wirewound resistor is shaped accordingly. Impedance alloy wire 7 is wound on the basic body; two ends of impedance alloy wire 7 are respectively welded to first metal cap 5*a* and second metal cap 5*b*. Then third lead wire 8 is further welded to first metal cap 5*a* as the output of the wirewound resistor. Finally, the device is encapsulated with insulating material 6. The insulating material 6 can be selected from the group consisting of epoxy resin, silicone or silicone rubber. In this embodiment, the insulating material 6 is epoxy resin. This way, a wirewound resistor with a built-in thermal fuse is achieved. The wirewound resistor on the external surface of the ceramic tube 1 can be changed into a carbon-film resistor, a metal-film resistor, a metal oxide film resistor or a thick film resistor, thus forming a resistor against over-temperature with different powers.

The Seventh Embodiment

FIG. 8 shows a resistor comprising a built-in thermal fuse with organic body for sensing temperature. Metal lining 20 is located on an inner wall of a hollow ceramic tube (not shown in the figure) and provides housing for organic temperature sensing body 19, sliding contact 16, first metal disc 17*a*, second metal disc 17*b*, first compressed spring 15, second compressed spring 18. One end of metal lining 20 closes and the other end opens. The thickness of the other end is made slight thinner to ensure first insulating element 14 is in a fixed position. First insulation element 14 is made of rigid materials which have special structures. In one specific embodiment, the upper and bottom part of the first insulating material are stuck in the other end of the opening due to the thinner thickness. One end of the organic temperature sensing body 19 pushes against the inner wall of one end of the opening for sensing temperature. The other end of organic temperature sensing body 19 is compressed by second compressed spring through second metal disc 17*b*. In another specific embodiment, two ends of metal lining 20 can both be opened, while the other end may be opened with a hole installed thereon. Second lead wire 2*b* is electrically connected with one end of the metal lining set with hole and fills the hole. A first compressed spring is located between first insulation material and sliding contact 16. Second compressed spring 18 is located between the first metal disc and the second metal disc. First compressed spring 15 and second compressed spring 18 are both compressed when the organic temperature sensing body is in rigid position. Sliding contact 16 is made of a conductive material and compressed by first compressed spring 15 and second compressed spring 18. The setting of first metal disc 17*a* and second metal disc 17*b* can result in a uniformed force distribution. The conductive sliding contact is electrically connected with metal lining 20. First lead wire 2*a* is electrically connected with sliding contact 16 when organic temperature sensing body 19 is in rigid position. Second lead wire 2*b* is electrically connected with the metal lining 20 through welding. First lead wire 2*a* passes through the middle of first insulating element 14 and is secured by first insulating element 14. When the organic temperature melts, the first and second compressed spring return back to its normal position and pushes conductive sliding contact 16 towards the organic temperature sensing body 19, thus separating conductive sliding contact 16 from first lead wire 2*a* and cutting off the electrically connection. Second insulating element 13 is used to seal one end of the opening. The material for second insulating element can be organic materials like epoxy. In this embodiment, organic temperature sensing body 19 is made of pure organic material while in another specific embodiment, a mixture of organic material and inorganic material is used as temperature sensing body 19. The inorganic material can be used to increase the rigidity of temperature sensing body 19.

The above-described embodiments are intended to illustrate, rather than limit the disclosure. Variations may be made to the embodiments without departing from the spirit of the disclosure as claimed. The above-described embodiments illustrate the scope of the disclosure, but do not restrict it.

The invention claimed is:

1. A device comprising:

a thermal fuse;

a resistor;

wherein the thermal fuse further comprises a first lead wire, a second lead wire, a low melting point metal wire, welded between the first lead wire and the second lead wire, a fluxing promoting agent, disposed around the low melting point metal wire, a hollow ceramic tube, providing a housing for the low melting point metal wire and the fluxing promoting agent, and a first insulating material, sealed at two ends of the hollow ceramic tube, wherein the first lead wire and the second lead wire respectively pass through the first insulating material at the two ends of the hollow ceramic tube, wherein the resistor further comprises a resistor body, a first metal cap and a second metal cap, locking the two ends of the hollow ceramic tube to form a tight integration and electrically connecting with two ends of the resistor body, and a second insulating material, located on an outer surface of the hollow ceramic tube;

wherein the hollow ceramic tube is commonly used by the thermal fuse and the resistor, the first lead wire and the second lead wire respectively pass through the first metal cap and the second metal cap, and wherein the thermal fuse, the resistor body, the first metal cap and the second metal cap are encapsulated in the second insulating material, and the second insulating material is selected from a group consisting of epoxy resin, silicone, silicone rubber and inorganic material.

2. The device of claim 1, wherein the fluxing promoting agent is configured to make the low melting point metal wire contract oppositely and cut off when melting; wherein the fluxing promoting agent and the low melting point metal wire form an integration under normal temperature.

3. The device of claim 1, wherein the first lead wire electrically connects with the first metal cap, the resistor is in serial connection with the thermal fuse.

4. The device of claim 1, wherein the device is configured as a basic unit and disposed directly in a switch-mode power supply.

5. The device of claim 1, wherein a resistance value of the resistor body is coupled with the temperature value of the thermal fuse, for accelerating a cut-off of the thermal fuse when the resistor body is heated and applied in over-temperature protection for the motor.

6. The device of claim 5, wherein the resistor is a carbon-film resistor, a wire wound resistor, a metal oxide film resistor or a metal-film resistor, configured to increase the resistance value to thousands of ohms, forming a heating resistor for the over-temperature protection.

7. The device of claim 1, wherein the first metal cap and the second metal cap are respectively disposed with an opening; wherein the first lead wire and the second lead wire respectively pass through openings of the first metal cap and the second metal cap and extend outwardly from the openings:

wherein the resistor further comprises a third lead wire and a fourth lead wire; the third lead wire is electrically connected with the first metal cap and the fourth lead wire is electrically connected with the second metal cap and respectively extend outwardly, forming a circuit that the thermal fuse and the resistor are parallel to each other.

8. The device of claim 1, wherein one end of the hollow ceramic tube opens and the other end of the hollow ceramic tube closes with a hole to let the first or the second lead extend out.

9. A device comprising:
a thermal fuse;
a resistor located on an outer surface of the thermal fuse;
a protective casing;
wherein the thermal fuse further comprises
a first lead wire,
a second lead wire,
a low melting point metal wire, welded between the first lead wire and the second lead wire,
a fluxing promoting agent disposed around the low melting point metal wire,
a hollow ceramic tube,
a first insulating material sealed at two ends of the hollow ceramic tube;
wherein the resistor further comprises
a resistor body,
a first metal cap and a second metal cap, locking the two ends of the hollow ceramic tube to form a tight integration, and electrically connecting with two ends of the resistor body,
a second insulating material located on an outer surface of the hollow ceramic tube,
wherein the hollow ceramic tube is commonly used by the thermal fuse and the resistor,
the thermal fuse, the resistor body, the first metal cap and the second metal cap are encapsulated in the second insulating material, and
the thermal fuse and the resistor are located in the protective casing.

10. The device of claim 9,
wherein and the first lead wire and the second lead wire respectively pass through the first insulating material at two ends of the hollow ceramic tube.

11. The device of claim 10, wherein the first lead wire and the second lead wire respectively pass through the first metal cap and the second metal cap.

12. The device of claim 9, wherein the resistor is selected from a group consisting of a wire wound resistor, a carbon film resistor, a metal film resistor and a metal oxide film resistor.

13. The device of claim 9, wherein a material of the second insulating material is selected from a group consisting of epoxy resin, silicone, silicone rubber and inorganic material.

14. The device of claim 9, wherein the protective casing is selected from a group consisting of a ceramic case, a plastic case, a heat-shrinkable tube and a non-heat-shrinkable tube.

15. The device of claim 9, wherein the first lead wire is electrically connected with the first metal cap, and the resistor is in serial connection with the thermal fuse.

16. The device of claim 9,
wherein the first metal cap and the second metal cap are respectively disposed with an opening; wherein the first lead wire and the second lead wire respectively pass through openings of the first metal cap and the second metal cap and extend outwardly from the openings; and
wherein the resistor further comprises a third lead wire and a fourth lead wire;
the third lead wire is electrically connected with the first metal cap and the fourth lead wire is electrically connected with the second metal cap and are respectively extended outwardly, forming a circuit that the thermal fuse and the resistor are parallel to cacti other.

17. A device comprising:
a thermal fuse;
a resistor located on an outer surface of the thermal fuse;
a protective casing;
wherein the thermal fuse further comprises
a first lead wire,
a second lead wire
a low melting point metal wire welded between the first lead wire and the second lead wire,
a fluxing promoting agent disposed around the low melting point metal wire,
a hollow ceramic tube,
a first insulating material sealed at two ends of the hollow ceramic tube,
wherein the resistor further comprises
a resistor body,
a first metal cap and a second metal cap, locking two ends of the hollow ceramic tube to form a tight integration, and electrically connecting with two ends of the resistor body,
a second insulating material located on an outer surface of the hollow ceramic tube,
wherein the hollow ceramic tube is commonly used by the thermal fuse and the resistor,
the thermal fuse, the resistor body, the first metal cap and the second metal cap are encapsulated in the second insulating material,
the thermal fuse and the resistor are located in the protective casing,
wherein the thermal fuse further comprising
a metal lining, located in an inner side of the hollow ceramic tube, and comprising a first end and a second end opposite to the first end;
an organic temperature sensing body, located at the second end;
a first insulating element, firmly located at the first end;
a conductive sliding contact, located between the first insulating element and the organic temperature sensing body, and electrically connected with the metal lining;
a first compressed spring, located between the first insulating element and the conductive sliding contact;
a second compressed spring, located between the conductive sliding contact and the organic temperature sensing body;
the first lead wire passing through the first insulating element and is electrically connecting with the conductive sliding contact; and
the second lead wire electrically connected with the metal lining.

18. The device of claim 17, wherein the thermal fuse further comprising:
a first disc, located between the conductive sliding contact and the second compressed spring; and
a second disc, located between the second compressed spring and the organic temperature sensing body.

19. The device of claim 17, wherein the thermal fuse further comprising:
a second insulating element sealing at an open end.

20. The device of claim 17, wherein the organic temperature sensing body is made from an organic material or a mixture of organic material and inorganic material.

* * * * *